US009382657B1

(12) United States Patent
Brooke

(10) Patent No.: US 9,382,657 B1
(45) Date of Patent: Jul. 5, 2016

(54) ASSISTANCE DEVICE FOR FOLDING ARTICLES OF FABRIC

(71) Applicant: Roseann Brooke, Staten Island, NY (US)

(72) Inventor: Roseann Brooke, Staten Island, NY (US)

( * ) Notice: Subject to any disclaimer, the term of this patent is extended or adjusted under 35 U.S.C. 154(b) by 0 days.

(21) Appl. No.: 14/461,820

(22) Filed: Aug. 18, 2014

Related U.S. Application Data

(60) Provisional application No. 61/866,673, filed on Aug. 16, 2013.

(51) Int. Cl.
*D06F 57/08* (2006.01)
*D06F 89/00* (2006.01)

(52) U.S. Cl.
CPC ..... *D06F 57/08* (2013.01); *D06F 89/00* (2013.01)

(58) Field of Classification Search
CPC ..... D06F 89/00; D06F 89/005; D06F 89/02; D06F 89/023; D06F 57/08
USPC ..... 223/37
See application file for complete search history.

(56) References Cited

U.S. PATENT DOCUMENTS

| | | | | |
|---|---|---|---|---|
| 3,236,425 | A * | 2/1966 | Sipe | 223/37 |
| 3,538,555 | A * | 11/1970 | Langston | 223/37 |
| 5,746,329 | A | 5/1998 | Rondeau | |
| 5,816,434 | A | 10/1998 | Weinstein | |
| D525,061 | S | 7/2006 | Abdi et al. | |
| D579,248 | S | 10/2008 | Goodman et al. | |
| D582,708 | S | 12/2008 | Goodman et al. | |
| 8,292,094 | B2 | 10/2012 | Morton | |
| 8,387,838 | B2 | 3/2013 | Adams et al. | |
| 2011/0253755 | A1* | 10/2011 | Adams et al. | 223/37 |
| 2012/0280094 | A1 | 11/2012 | Post | |
| 2013/0045850 | A1* | 2/2013 | Reinhart | 493/405 |

* cited by examiner

*Primary Examiner* — Nathan Durham
(74) *Attorney, Agent, or Firm* — Robert C. Montgomery; Montgomery Patent & Design, LLC

(57) ABSTRACT

An assistance device for folding an article comprises an angled structure having magnetic retention clamps that hangs upon a top door edge and holds the article while a user folds the article. An upper portion of the structure is provided with at least two (2) brackets that slidably receive an upper edge of a door and support the device. Extending from each bracket is a telescoping extender bar which provides height adjustability. At a distal end of each extender bar is a cross bar connecting the extender bars together. An article is secured to retainer clamps on the cross bar, thereby allowing the device to support the article to assist a user while attempting to fold it.

16 Claims, 7 Drawing Sheets

ASSISTANCE DEVICE FOR FOLDING ARTICLES OF FABRIC

RELATED APPLICATIONS

The present invention was first described in and claims the benefit of U.S. Provisional Application No. 61/866,673, filed Aug. 16, 2013, the entire disclosures of which are incorporated herein by reference.

FIELD OF THE INVENTION

The present invention relates to an adjustable frame and bracket device that secures to a door and assists a user with folding articles of fabric, such as garments, linen, blankets, and the like.

BACKGROUND OF THE INVENTION

One (1) common task that many of us face on laundry day is the folding of bed sheets, blankets, comforters, and other similar linens. Should two (2) people be available, the folding process proceeds very quickly resulting in folded linens that are neat, orderly, and occupy a minimum amount of space. However, in most cases, the person doing laundry is on their own. As such, these linen products end up with a haphazard appearance that not only is unpleasing to look at, but occupy a large amount of wasted space in closets or drawers. Others may resort to laying large items on floors to help fold them, but such action results in dust, dirt, pet hair, and other contaminants getting on the items. Accordingly, there exists a need for a means by which large linen items such as sheets, blankets, comforters, and the like, can be easily and neatly folded by only one (1) person in order to address the problems as described above. The use of the device allows for the folding of large linen articles in a manner which is quick, easy, and effective.

SUMMARY OF THE INVENTION

The inventor has seen a need for such as device to assist in the folding of large articles of fabric, like blankets, comforters, and the like. As such, the inventor has provided for an adjustable hanger able to be suspended from a door or similar support structure.

It is an object of the present invention to provide such an adjustable hanger having a cross bar having a pair of "L"-shaped tubular members removably attached to distal ends thereof. The tubular members are each independently adjustably attached to an extender tube. The extender tubes are each attached to a "U"-shaped bracket that is supported on the support structure as mentioned above.

It is a further object of the present invention to provide at least one (1) clamping device located on the cross bar that is capable of retaining a portion of the article to be folded. In at least one (1) embodiment, the clamping device is magnetic.

It is a further object of the present invention to provide a means to enable the clamping device to be slidably adjustable along a length of the cross bar. In at least one (1) embodiment, such a means is accomplished with a spring tension clamp.

It is an object of the present invention to provide either a cotter pin, a hairpin, a split pin, a positive lock pin, or a similar fastening means for fastening the cross bar to each tubular member. A similar fastening means is used to fasten each extender tube to a bracket.

It is yet another object of the present invention to provide a spring-loaded pin assembly located on each extender tube capable of being aligned with and securely retained in an individual one (1) of a plurality of apertures located on each tubular member.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
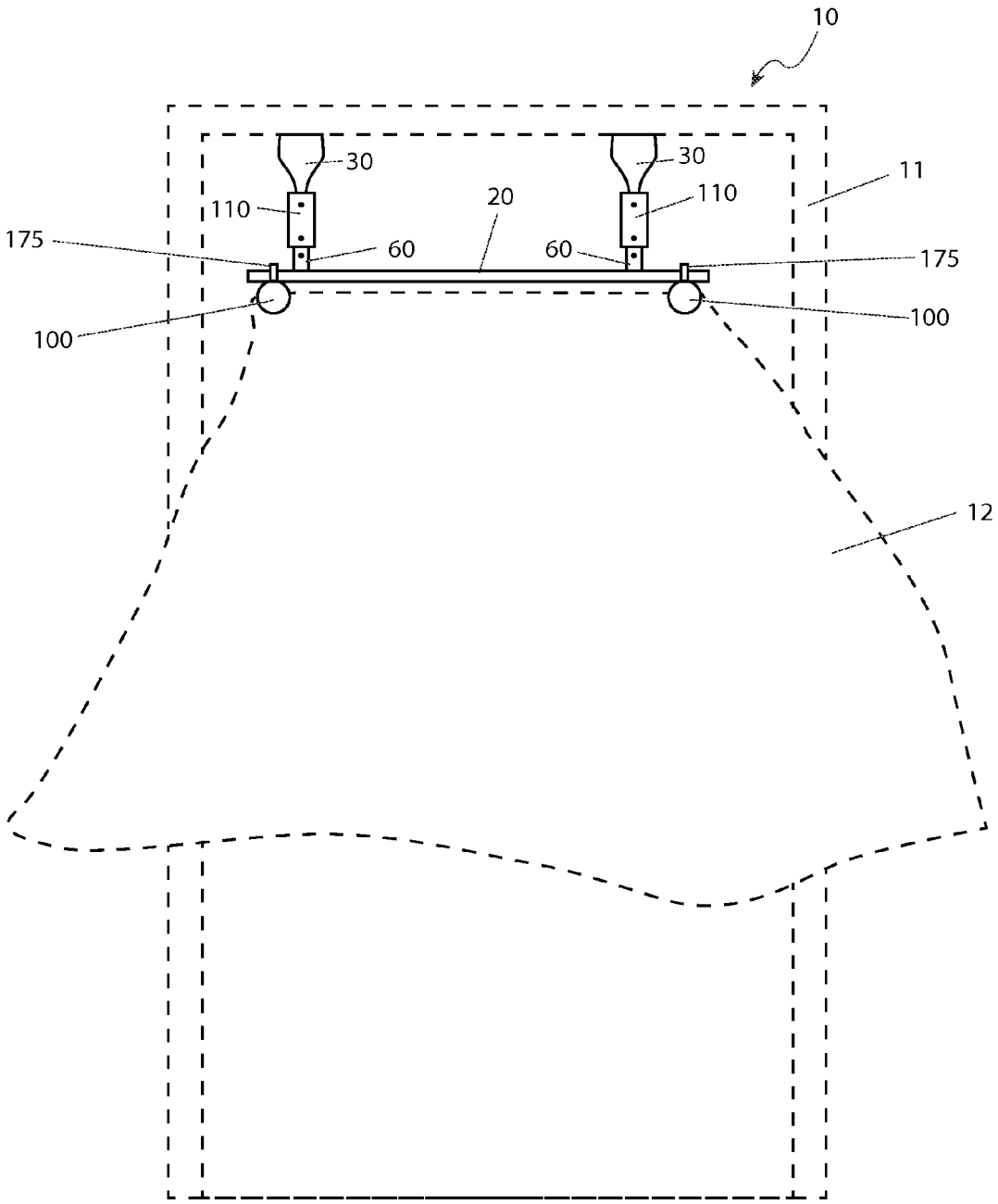
FIG. 1 is an environmental view of an assistant device for folding articles of fabric 10, according to a preferred embodiment of the present invention.

10 assistant device for folding articles of fabric
11 door
12 fabric article
20 frame
30 bracket
40 support bar
50 shank
60 "L"-shaped pole
70 first aperture
80 second aperture
90 fastening mechanism
100 magnetic clamp assembly
110 extender pole
120 third aperture
130 vertical extension
140 spring-pin
142 button
150 fourth aperture
160 fifth aperture
170 case hinge
175 jaw assembly
180*a* stationary jaw
180*b* pivoting jaw
182 actuator lever
184 jaw hinge
190 first end
200 second end
210*a* front magnet
210*b* rear magnet
220*a* front case
220*b* rear case

DETAILED DESCRIPTION OF THE PREFERRED EMBODIMENT

The best mode for carrying out the invention is presented in terms of its preferred embodiment, herein depicted within FIGS. 1 through 7*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an assistant device for folding articles of fabric (herein described as the "device") 10 that secures to a door 11 via brackets 30, and provides a means to clamp folding fabric articles 12 of fabric to assist in folding. It is assumed that non-fabric articles can be similarly supported.

Figure 2:
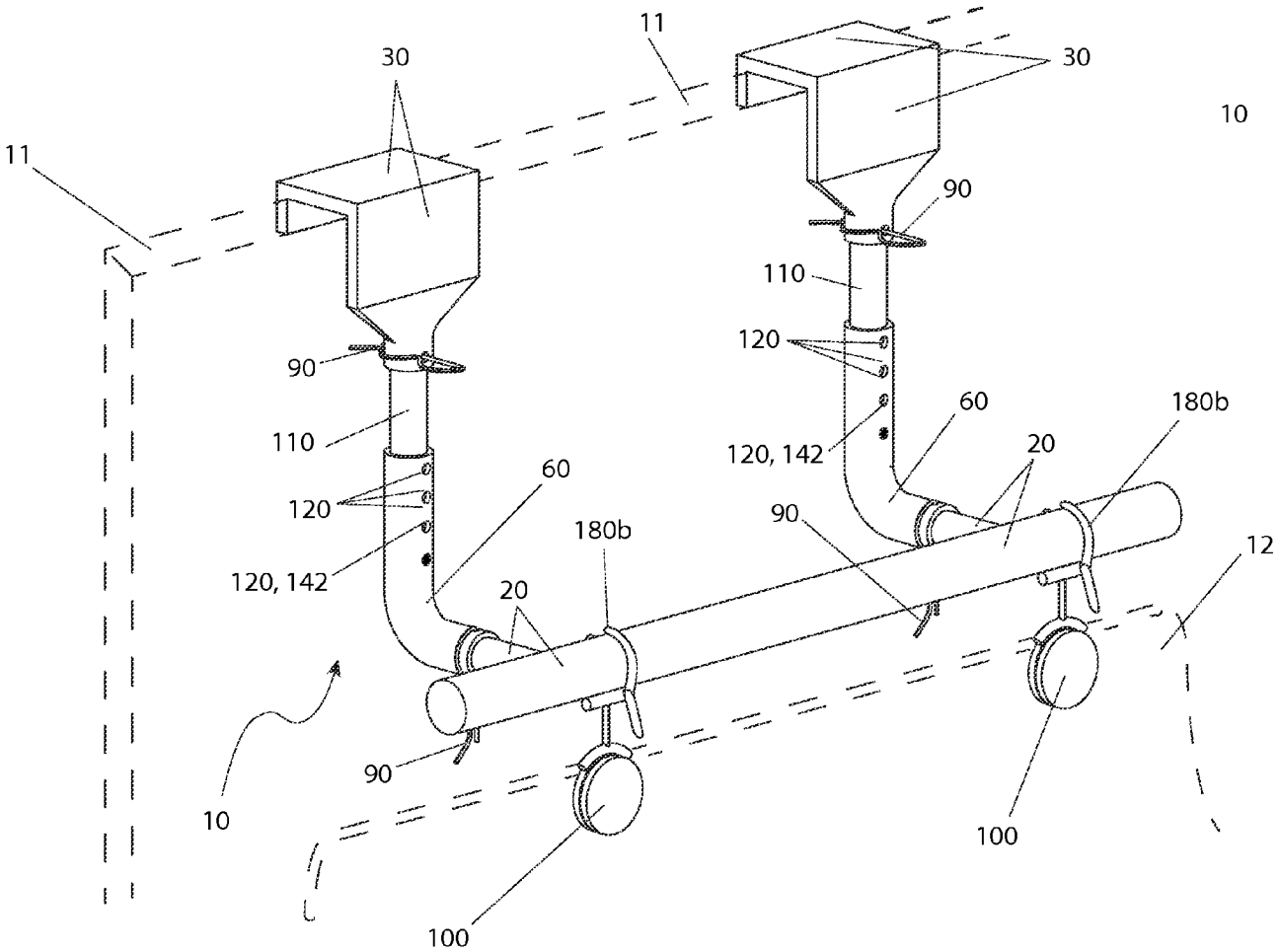
FIG. 2 is a close-up perspective view of the assistant device 10, according to a preferred embodiment of the present invention.

Referring now to FIGS. 1 and 2, environmental views of the device 10, according to a preferred embodiment of the present invention, are disclosed. The device 10 comprises an adjustable frame 20 that secures to a top portion of a door 11 via two (2) brackets 30 extending from the frame 20. The device 10 is further provided with pinch-style magnetic clamp assemblies 100 to assist in suspending a fabric article 12 from the frame 20, allowing the device 10 to assist a user with folding the fabric article 12. Positioning of the frame 20 in a vertical direction is enabled by variable connection of an "L"-shaped pole portion 60 and an extender pole portion 110 which insert into each other in a telescoping manner and are secured by insertion of a spring-pin portion 140 into one (1) of a plurality of third apertures 120 (see FIGS. 3,4 and 5).

To use the device 10, a user places and secures two (2) adjacent corner portions of the fabric article 12, such as a large blanket, within each magnetic clamp assembly 100. The user then grabs the other two (2) corners, and proceeds to fold the fabric article 12 in a conventional manner. When folded, the user brings the outer two (2) corners up to the magnetic clamp assemblies 100, and replaces the held fabric with the two (2) new corners. Next, the remaining fabric article 12 is folded again. As the folded fabric article 12 becomes physically smaller, the magnetic clamp assemblies 100 are adjusted inward on the frame 20 such that the material remains taut. This process is repeated as necessary until the desired size of the folded linen is obtained.

Figure 3:
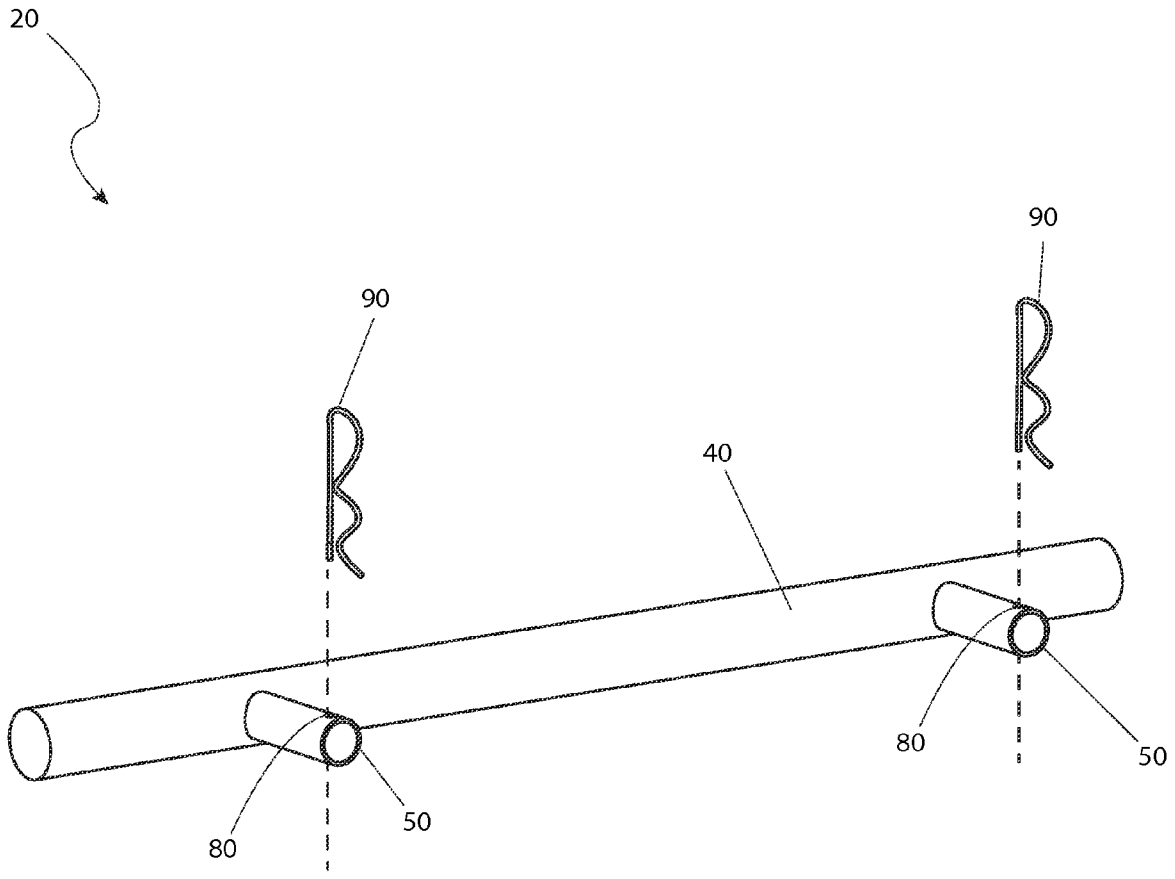
FIG. 3 is a front perspective view of a frame 20, according to a preferred embodiment of the present invention.

Referring now to FIG. 3, a front perspective view of a frame 20, according to a preferred embodiment of the present invention, is disclosed. The frame 20 is fabricated from a lightweight, rigid tubular material, preferably comprising a plastic, aluminum, or steel alloy. The frame 20 includes a support bar 40 comprising an elongated cylindrical tubular member. Extending perpendicularly from the support bar 40, proximate to distal end portions thereof, are cylindrical shank portions 50. Each shank 50 slidably inserts into an "L"-shaped pole 60 (see FIGS. 2 and 4). Each "L"-shaped pole 60 has a hollow construction and an inner diameter slightly larger than that of the outer diameter of each shank 50 so as to enable each shank 50 to slidably insert into each "L"-shaped pole 60. Each "L"-shaped pole 60 is provided with a first aperture 70, which is configured to align with a second aperture 80 of each shank 50 when each "L"-shaped pole 60 is slid over each shank 50. The apertures 70, 80 are used to enable securement of each "L"-shaped pole 60 with each shank 50 via a fastening mechanism 90 such as a quick-disconnect device such as a detent pin, a hair pin, a cotter pin, a split pin, a positive lock pin, or similar fastening device; however, other fastening mechanisms 90 and fastening methods may be utilized without deviating from the teachings of the device 10, and as such should not be interpreted as a limiting factor of the device 10.

Figure 4:
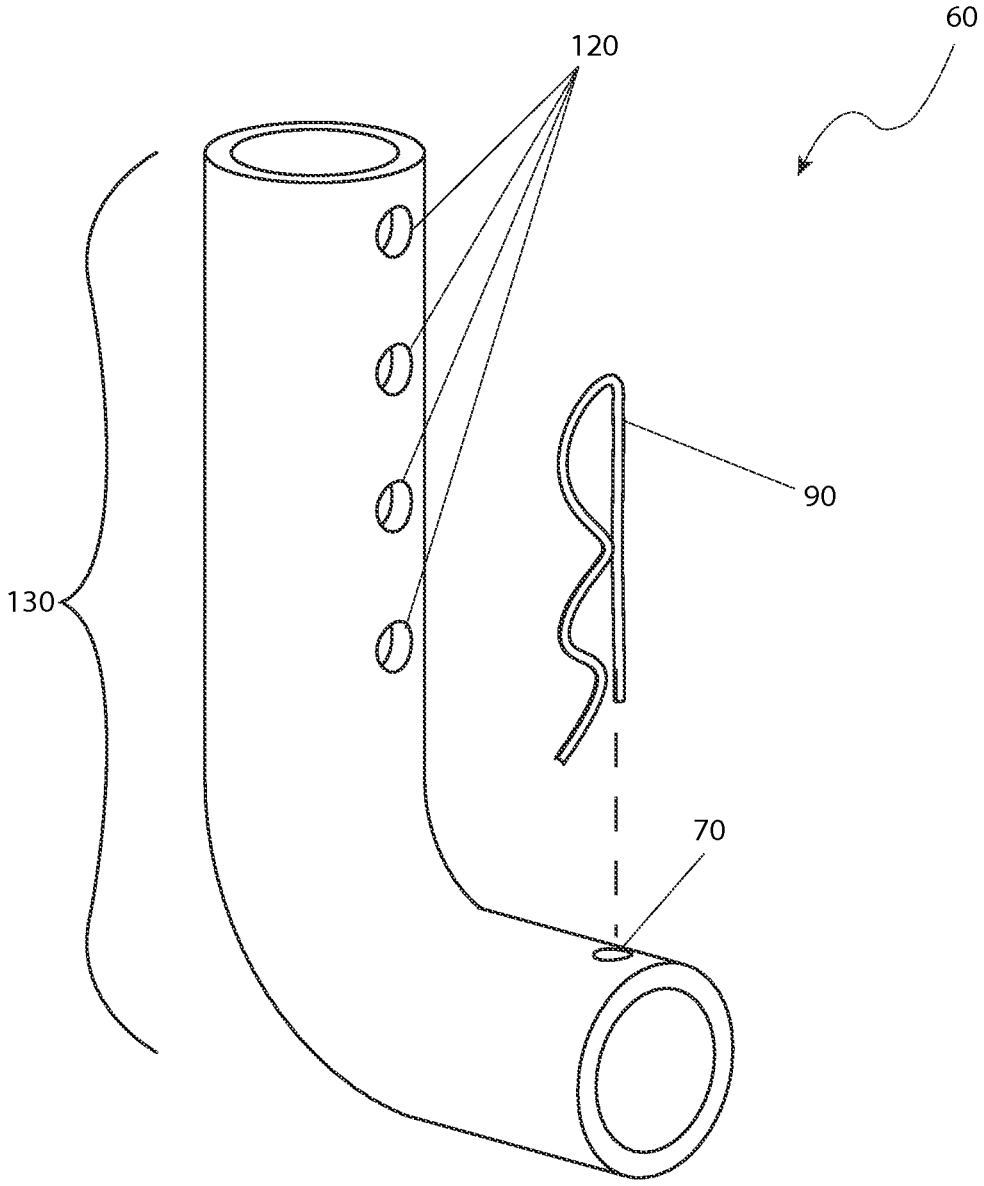
FIG. 4 is a front view of an "L"-shaped pole 60, according to a preferred embodiment of the present invention.
Figure 5:
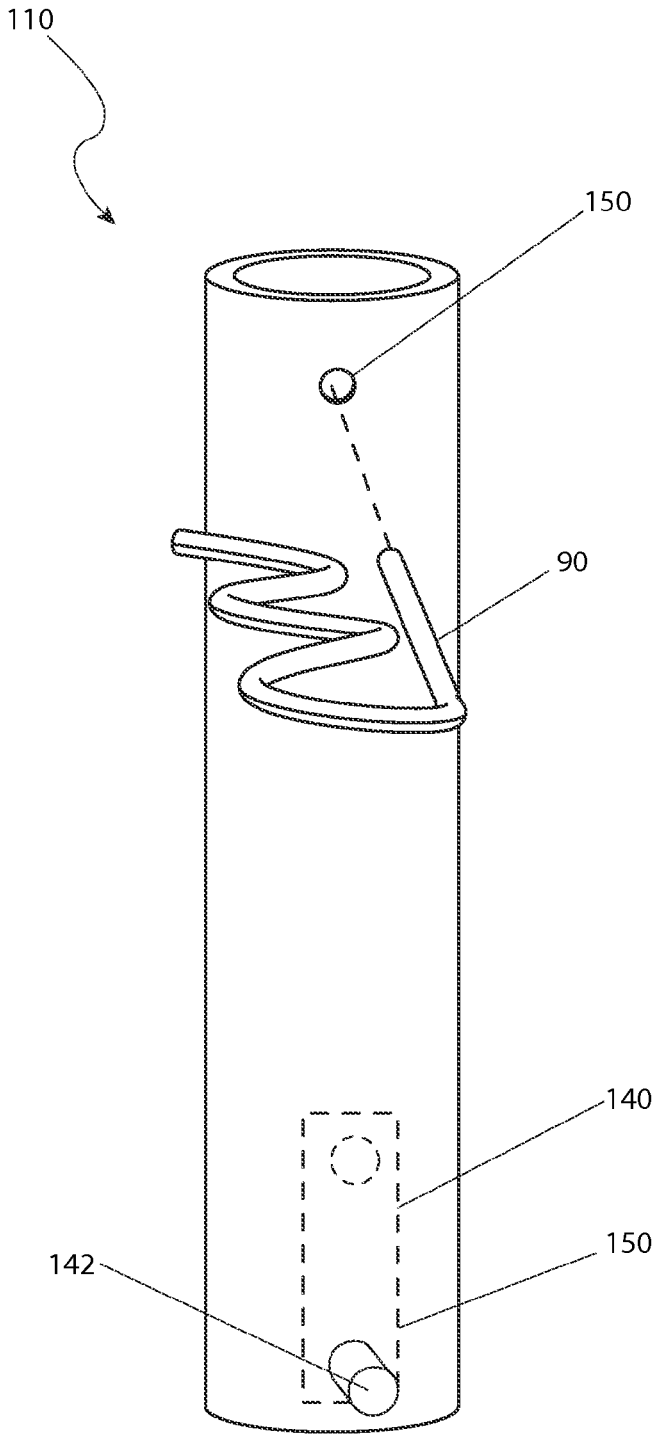
FIG. 5 is a front view of an extender pole 110, according to a preferred embodiment of the present invention.

Referring now to FIGS. 4 and 5, a front view of an "L"-shaped pole 60 and a front view of an extender pole 110, according to a preferred embodiment of the present invention, are disclosed. Each "L"-shaped pole 60 extends from each shank 50 approximately three inches (3 in.) before making a ninety-degree (90°) upward turn to form a vertical extension 130 being approximately twelve inches (12 in.) in length. Disposed along a side of each vertical extension 130 are a plurality of equidistant third apertures 120 which provide selective attachment to a fourth aperture portion 150 of an extender pole 110. The extender pole 110 is slidably inserted over each vertical extension portion 130 of each "L"-shaped pole 60. Each extender pole 110 has an outer diameter slightly smaller than an inner diameter of each "L"-shaped pole 60 so as to enable each "L"-shaped pole 60 to slidably receive each extender pole 110 and allow each extender pole 110 to traverse the length of each twelve-inch extension 130. Each extender pole 110 includes an internal spring-pin 140 having a button portion 142 biased outwardly so as to be inserted into an aligned third aperture portion 120 of the "L"-shaped pole 60. As each extender pole 110 is slid into each "L"-shaped pole 60, and the button portion 142 of the spring-pin 140 makes contact with an edge of the "L"-shaped pole 60, causing the button 142 to be retracted from its forward bias position. As the extender pole 110 is further slid into the "L"-shaped pole 60 to traverse the vertical extension 130, the button 142 makes contact with one (1) of the third apertures 120, allowing the button 142 to extend to its forward bias position within the third aperture 120, thereby locking the "L"-shaped pole 60 to the extender pole 110 at a desired position. If a user desire to extend the length of the frame 20 further, the spring-pin 140 is depressed to disengage the button 142 pin from the third aperture 120. The extender pole 110 is then slid until the button 142 comes into contact with an adjacent third aperture 120, where it is locked into place again. This spring-pin 140 and third aperture 120 configuration enables vertical adjustment of the distance of the "L"-shaped pole 60 from the support bar 40 (see FIG. 2) while the device 10 is secured to a door 11 (see FIG. 1).

Figure 6:
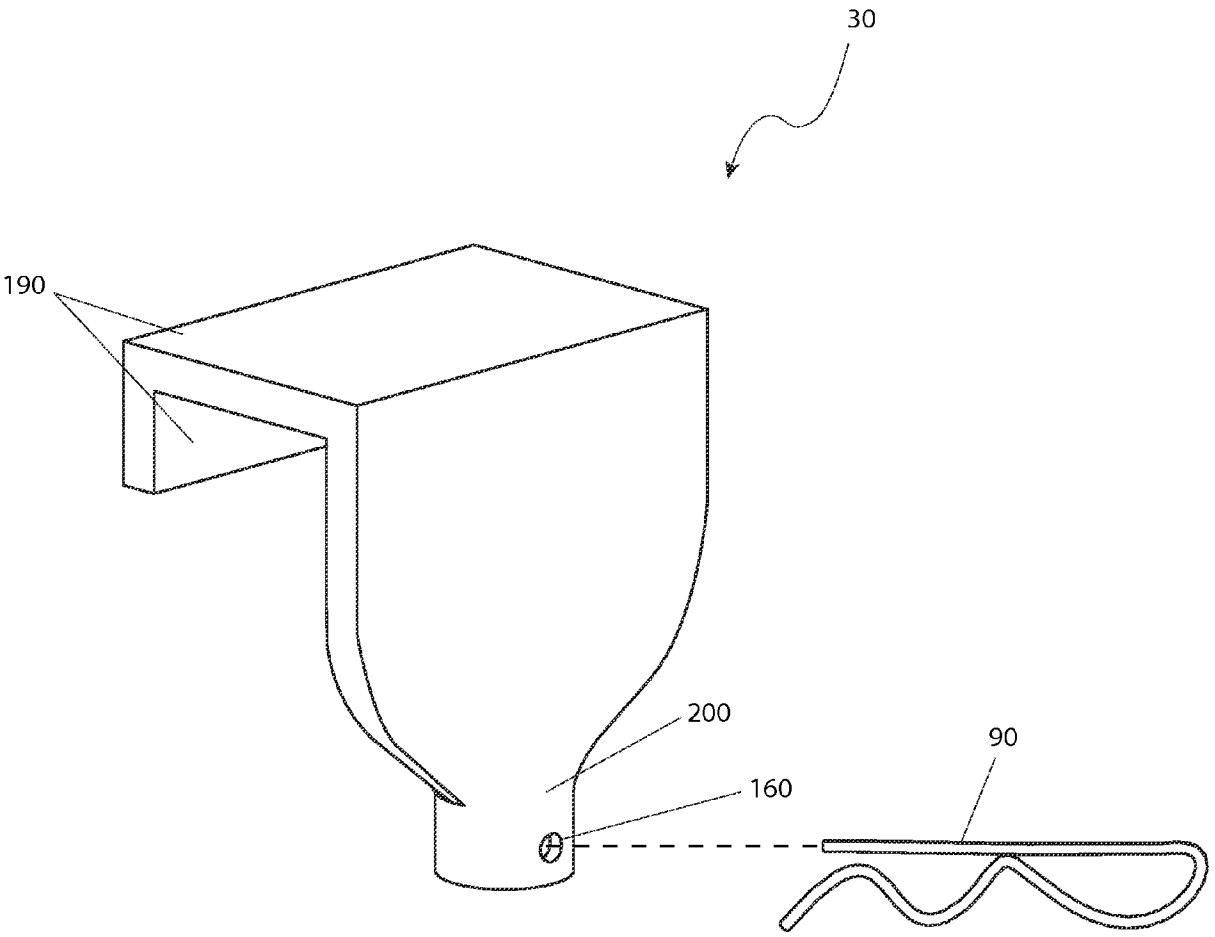
FIG. 6 is a front perspective view of a bracket portion 30, according to a preferred embodiment of the present invention.

Referring now to FIG. 6, a front perspective view of a bracket portion 30, according to a preferred embodiment of the present invention, is disclosed. The device 10 is provided with two (2) brackets 30. Each bracket 30 is fabricated from a light weight rigid material, preferably comprising a plastic, aluminum, or steel alloy. Each bracket 30 is configured to have a channel-shaped construction at a first end 190, where the bracket 30 forms a general "U"-shape. A second end 200 of each bracket is configured to be a hollow tubular member having an inner diameter slightly larger than that of an outer diameter of each extender pole 110 so that each second end 200 slidably receives each extender pole 110. Distal ends of each extender pole 110 are provided with a fourth aperture 150 (see FIG. 5), and a side surface of each second end 200 of each bracket 30 is further provided with a fifth aperture 160. The apertures 150, 160 are used to enable securement of each bracket 30 with each extender pole 110 via another fastening mechanism 90 similar to that used to secure each "L"-shaped pole 60 to each shank 50. The U-shaped configuration of the bracket 30 enables a user to hang the device 10 over a top portion of a door 11 or similar object (see FIGS. 1 and 2).

Figure 7B:
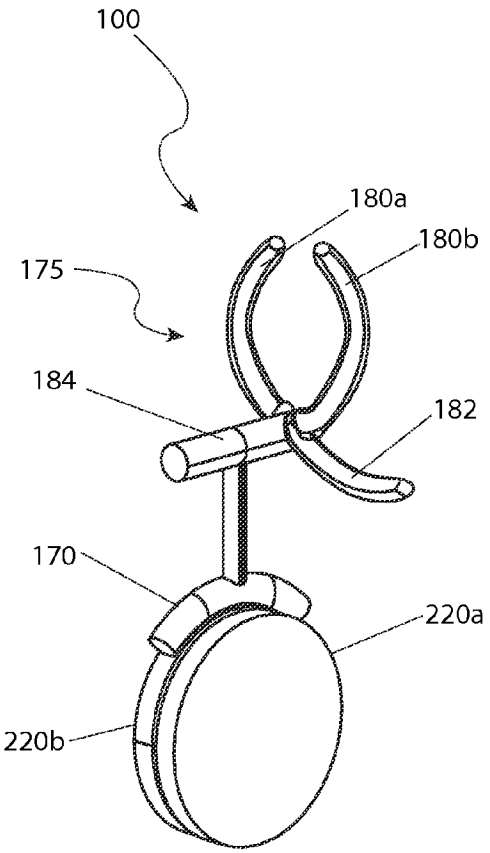
FIG. 7*a* is a perspective view of a magnetic clamp assembly 100 in an opened position, according to a preferred embodiment of the present invention; and, FIG. 7*b* is another perspective view of the magnetic clamp assembly 100 in a closed position, according to a preferred embodiment of the present invention.
Figure 7A:
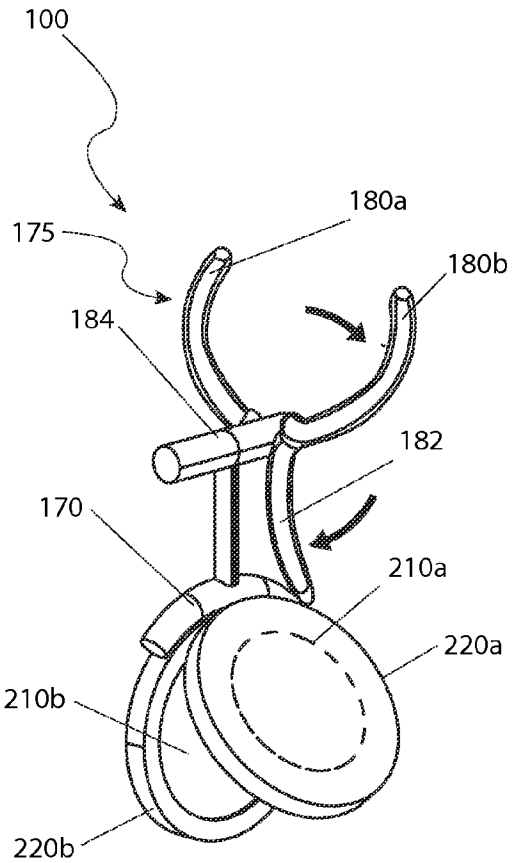

Referring now to FIGS. 7*a* and 7*b*, front perspective views of the magnetic clamp assembly 100 in opened and closed positions, according to a preferred embodiment of the present invention, are disclosed. The device 10 is further provided with at least two (2) magnetic clamp assemblies 100. Each magnetic clamp assembly 100 includes a front magnet 210*a* and a rear magnet 210*b*, each encased within respective front case 220*a* and rear case 220*b* portions. The cases 220*a*, 220*b* are connected to each other with a case hinge 170 along a top joining edge portion. Each case hinge 170 includes an integral spring-loaded jaw assembly 175 including a stationary jaw 180*a* and a pivoting jaw 180*b* having an integral actuator lever 182, joined by a jaw hinge 184. The spring-loaded jaw hinge 184 acts to bias the pivoting jaw 180*b* against the stationary jaw 180*a*. The jaws 180*a*, 180*b* provide mirror-image semicircular forms having diameters allowing the jaw assembly 175 to fit snuggly around the support bar 40 when closed. Each of the magnetic clamp assemblies 100 may be easily removed from the frame 20 by pressing upon the actuator lever 182 to open the jaws 180*a*, 180*b*. The magnets 210*a*, 210*b* of each magnetic clamp assembly 100 are positioned to have a magnetic orientation opposite that of the complementing magnet 210*a*, 210*b* so that when each magnet 210*a*, 210*b* is brought within proximity to each other, the magnetic fields interact to attract the magnets 210*a*, 210*b* towards each other.

Each magnetic clamp assembly 100 is removably positioned on the support bar 40 (see FIG. 2), and the configuration of the jaw assemblies 175 enables the magnetic clamp assemblies 100 to slide to various positions along the support bar 40 (see FIG. 2). This ability to slide each magnetic clamp assembly 100 enables various sized fabric articles 12 to be supported thereon (see FIG. 1), and also to be repositioned as each fabric article 12 is folded into a smaller configuration. Once in a desired position about the support bar 40, the front case 220*a* and rear case 220*b* are pivoted open to receive a corner of the fabric article 12 (see FIG. 1) about to be folded. Once the fabric article 12 (see FIG. 1) is in place, the magnets 210*a*, 210*b* of the magnetic clamp assemblies 100 are allowed to attract and retain the fabric article 12 in place while a user manipulates the fabric article 12 to fold it.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the enabled user in a simple and straightforward manner with little or no training. The device 10 would be configured as indicated in FIG. 1 upon the initial purchase or acquisition.

The method of assembling and installing the device 10 may be achieved by performing the following steps: acquiring the device 10; assembling the portions of the device 10 together, if not previously assembled by inserting the shank portions of the frame 20 into respective "L"-shaped poles 60; securing the shanks 50 to the "L"-shaped poles 60 by inserting respective fastening mechanisms 90 through respective first aperture 70 and second aperture 80 portions; inserting a lower end portion of each extender pole 110 into a top opening portion of each "L"-shaped pole 60; locking the extender poles 110 at a desired inserted length via engagement of respective spring-pin portions 140 into a desired aligned third aperture 120 portion of the "L"-shaped pole 60; inserting an upper end portion of each extender pole 110 into respective second end portions 200 of the brackets 30; securing the extender poles 110 to the brackets 30 using fastening mechanisms 90; hanging the device 10 upon a door 11 by hooking the first end portions 190 of the brackets 30 over the door 11; attaching the magnetic clamp assemblies 100 to the support bar portion 40 of the frame 20 by opening the jaw assemblies 175 by pressing upon the actuator levers 182; inserting the jaws 180*a*, 180*b* over the support bar 40; releasing the actuator levers 182; and, extending or retracting each extender pole 110 to position the frame 20 and magnetic clamp assemblies 100 at a desired height by depressing the button portions 142 of the extender poles 110 for insertion into a desired third aperture 120 as previously described. The device 10 is now ready for use.

The method of utilizing the device 10 to fold a fabric article 12 may be achieved by performing the following steps: sliding each magnetic clamp assembly 100 laterally along the support bar 40 to obtain a desired gap therebetween; separating the front case 220*a* and rear case 220*b* portions of the magnetic clamp assemblies 100, and integral magnet portions 210*a*, 210*b*, outwardly; positioning corners of a fabric article 12 to be folded between the magnet portions 210*a*, 210*b* of respective magnetic clamp assemblies 100; pressing the cases 220*a*, 220*b* together to clamp and suspend the fabric article 12 in place; and, allowing the device 10 to support the fabric article 12 while manipulating the fabric article 12 and the magnetic clamp assemblies 100 to assist in folding the fabric article 12.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. An assistance device for folding an article comprising:

a cross bar, having a first shank extending perpendicularly from said cross bar proximate to a first distal end and a second shank extending perpendicularly from said cross bar proximate to a second distal end;

a first tubular member, having a first end slidably receiving said first shank and affixed thereto with a first fastening means, and a second end; and, a second tubular member, having a third end slidably receiving said second shank and affixed thereto with a second fastening means, and a fourth end;

a first extender tube having a proximal end slidably inserted into said second end of said first tubular member and affixed thereto with a first adjustment fastening means;

a second extender tube having a proximal end slidably inserted into said fourth end of said second tubular member and affixed thereto with a second adjustment fastening means;

a first bracket, having a fifth end, and a sixth end which slidably receives a distal end of said first extender tube and is affixed thereto with a third fastening means;

a second bracket, having a seventh end, and an eighth end which slidably receives a distal end of said second extender tube and is affixed thereto with a fourth fastening means; and, at least one article retention means disposed on said cross bar configured for securely retaining an article to said adjustable hanger;

wherein said fifth end of said first bracket and said seventh end of said second bracket are each configured to support a weight of said adjustable hanger and said article when supported on a support structure.

2. The assistance device for folding an article of claim 1, wherein said first, second, third, and fourth fastening means are each one of the following: a cotter pin, a hairpin, a split pin, or a positive lock pin.

3. The assistance device for folding an article of claim 1, wherein said first adjustment fastening means is:

a first spring-loaded pin assembly located on a side surface of said first extender tube; and, a first plurality of apertures located on a side surface of said second end of said first tubular member;

wherein a desired length of said first extender tube relative to said first tubular member is achieved upon alignment and engagement of said pin with a desired one of said first plurality of apertures.

4. The assistance device for folding an article recited in claim 3, wherein said first plurality of apertures are equidistant in spatial distance from each other.

5. The assistance device for folding an article of claim 1, wherein said second adjustment fastening means is:

a second spring-loaded pin assembly located on a side surface of said second extender tube; and, a second plurality of apertures located on a side surface of said fourth end of said second tubular member;

wherein a desired length of said second extender tube relative to said second tubular member is achieved upon alignment and engagement of said pin with a desired one of said second plurality of apertures.

6. The assistance device for folding an article recited in claim 5, wherein said second plurality of apertures are equidistant in spatial distance from each other.

7. The assistance device for folding an article recited in claim 1, wherein each article retention means is a magnetic clip, each comprising:

a casing, having a first compartment hingedly attached to a second compartment;

a first magnet positioned within said first compartment with its magnetic orientation in a first direction; and, a second magnet positioned within said second compartment with its magnetic orientation in a second direction, wherein said second direction is opposite said first direction; and, a spring tension clamp affixed to a rear portion of said casing.

8. The assistance device for folding an article recited in claim 7, wherein said spring tension clamp has a configuration matching a profile of said cross bar.

9. An assistance device for folding an article comprising:

a cross bar, having a first shank extending perpendicularly from said cross bar proximate to a first distal end and a second shank extending perpendicularly from a said cross bar proximate to a second distal end;

a first tubular member, having a first end slidably receiving said first shank and affixed thereto with a first fastening means, and a second end; and, a second tubular member, having a third end slidably receiving said second shank and affixed thereto with a second fastening means, and a fourth end;

a first extender tube having a proximal end slidably inserted into said second end of said first tubular member tube and affixed thereto with a first adjustment fastening means;

a second extender tube having a proximal end slidably inserted into said fourth end of said second tubular member and affixed thereto with a second adjustment fastening means;

a first bracket, having a fifth end, and a sixth end which slidably receives a distal end of said first extender tube and is affixed thereto with a third fastening means;

a second bracket, having a seventh end, and an eighth end which slidably receives a distal end of said second extender tube and is affixed thereto with a fourth fastening means; and, at least one article retention means disposed on said cross bar configured for securely retaining an article to said adjustable hanger;

wherein said fifth end of said first bracket and said seventh end of said second bracket are each configured to support a weight of said adjustable hanger and said article when supported on a support structure; and, wherein each article retention means is capable of being laterally adjustable about a longitudinal length of said cross bar.

10. The assistance device for folding an article of claim 9, wherein said first, second, third, and fourth fastening means are each one of the following: a cotter pin, a hairpin, a split pin, or a positive lock pin.

11. The assistance device for folding an article of claim 9, wherein said first adjustment fastening means is:

a first spring-loaded pin assembly located on a side surface of said first extender tube; and, a first plurality of apertures located on a side surface of said second end of said first tubular member;

wherein a desired length of said first extender tube relative to said first tubular member is achieved upon alignment and engagement of said pin with a desired one of said first plurality of apertures.

12. The assistance device for folding an article recited in claim 11, wherein said first plurality of apertures are equidistant in spatial distance from each other.

13. The assistance device for folding an article of claim 9, wherein said second adjustment fastening means is:

a second spring-loaded pin assembly located on a side surface of said second extender tube; and, a second plurality of apertures located on a side surface of said fourth end of said second tubular member;

wherein a desired length of said second extender tube relative to said second tubular member is achieved upon alignment and engagement of said pin with a desired one of said second plurality of apertures.

14. The assistance device for folding an article recited in claim 13, wherein said second plurality of apertures are equidistant in spatial distance from each other.

15. The assistance device for folding an article recited in claim 9, wherein each article retention means is a magnetic clip, each comprising:

a casing, having a first compartment hingedly attached to a second compartment;

a first magnet positioned within said first compartment with its magnetic orientation in a first direction; and, a second magnet positioned within said second compartment with its magnetic orientation in a second direction, wherein said second direction is opposite said first direction; and, a spring tension clamp affixed to a rear portion of said casing.

16. The assistance device for folding an article recited in claim 15, wherein said spring tension clamp has a configuration matching a profile of said cross bar.

* * * * *